United States Patent [19]

Mills et al.

[11] Patent Number: 4,660,985

[45] Date of Patent: Apr. 28, 1987

[54] METHODS FOR PRODUCING AERATED CEMENTITIOUS COMPOSITIONS

[75] Inventors: Peter S. Mills, Burton-on-Trent; Ivor K. Daly, Melbourne, both of England

[73] Assignee: Coal Industry (Patents) Limited, London, England

[21] Appl. No.: 786,627

[22] Filed: Oct. 11, 1985

Related U.S. Application Data

[62] Division of Ser. No. 607,805, May 4, 1984.

[30] Foreign Application Priority Data

May 5, 1983 [GB] United Kingdom ..... 831236

[51] Int. Cl.[4] ..... B28C 5/00; B28C 5/06

[52] U.S. Cl. ..... 366/5; 366/2

[58] Field of Search ..... 366/17, 606, 20, 27, 366/24, 35, 38, 50, 64, 66, 156, 157, 319, 322, 323, 290, 318, 29, 33, 42, 131, 139, 28, 184, 10–13, 15, 101–107, 189, 191, 192–196, 325, 329; 261/28, 133, 136, 146, 147

[56] References Cited

U.S. PATENT DOCUMENTS

| | | | |
|---|---|---|---|
| 2,633,340 | 3/1953 | Zagray et al. | 366/51 |
| 2,717,770 | 9/1955 | Gibson et al. | 261/28 |
| 3,227,426 | 1/1966 | Williams | 366/51 |
| 3,231,245 | 1/1966 | Harvey | 366/28 |
| 4,039,170 | 8/1977 | Cornwell et al. | 366/29 X |
| 4,117,547 | 9/1978 | Mathis et al. | 366/17 |
| 4,223,996 | 9/1980 | Mathis et al. | 366/27 |
| 4,408,886 | 10/1983 | Sampson et al. | 366/28 X |
| 4,436,431 | 3/1984 | Strong et al. | 366/132 |
| 4,449,826 | 5/1984 | Mathis et al. | 366/13 |

*Primary Examiner*—Timothy F. Simone

*Attorney, Agent, or Firm*—James C. Wray

[57] ABSTRACT

An aerated cementitious composition is produced by feeding a mixture comprising cement and foaming agent to a mixing chamber open to atmosphere together with a feed of liquid. The ingredients are mixed and the wetted mixture pumped to a desired site, the capacity of pumping being greater than the feed rate of the ingredients into the mixing chamber such that air is drawn into the mixing chamber.

8 Claims, 1 Drawing Figure

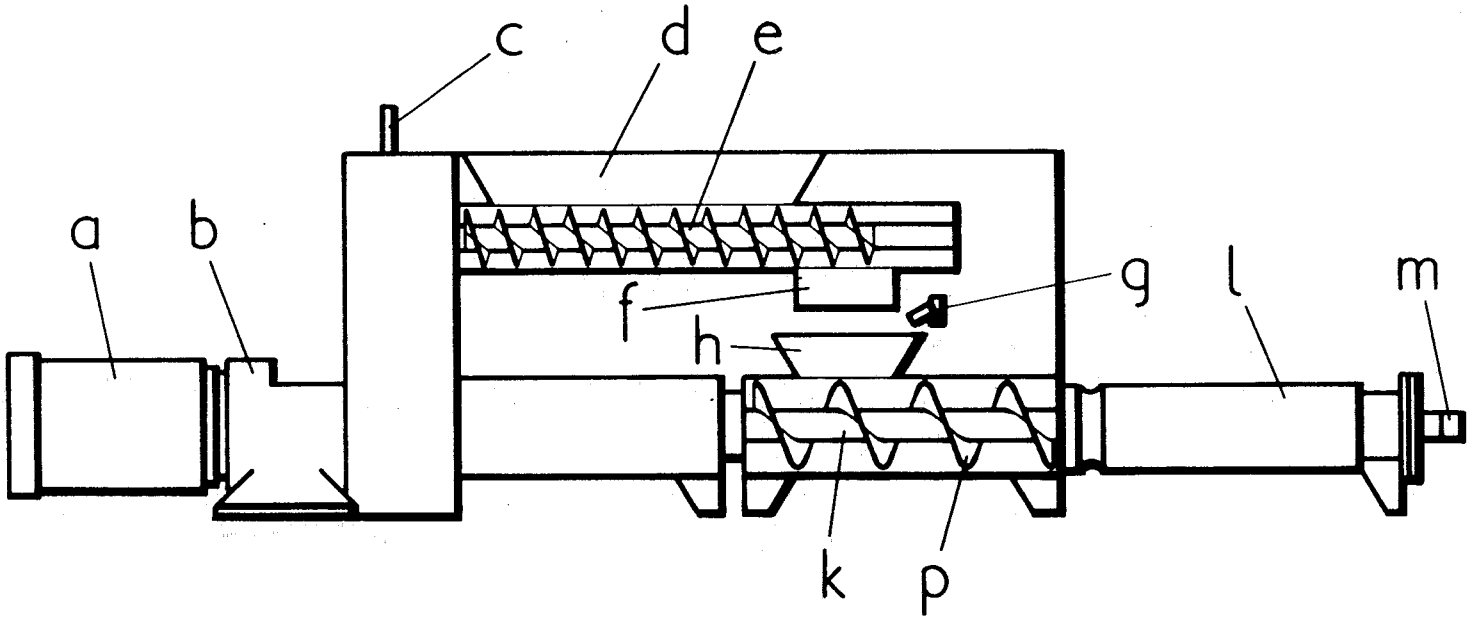
a
b
c
d
e
f
g
h
k
p
l
m

METHODS FOR PRODUCING AERATED CEMENTITIOUS COMPOSITIONS

This application is a division of application Ser. No. 607,805, filed May 4, 1984.

BACKGROUND OF THE INVENTION

This invention relates to a method of and apparatus for producing aerated cementitious compositions.

In particular, although not exclusively, the present invention relates to the production of lightweight aeerated cementitious compositions for filling or partly filling voids or cavities in underground mines.

In underground mines voids or cavities of varied and indeterminate size frequently occur as a result of mining operations. For example, cavities generally occur around roof supports installed in mine roadways or above roof supports installed along a working face. To promote efficient working of the underground mine the cavities are usually filled or partly filled with materials such as timber, broken rock or pumped cement grout. Unfortunately, difficulties are frequently experienced when filling cavities with these materials, for example, the infilling of cavities on a working face with timber can be potentially hazardous operation as there is a danger of rocks falling off the sides of a cavity and falling on the operators below. Cement grouts have specific gravities of above 1.0 and because of this they are especially difficult to contain within overhead cavities particularly when the available shuttering is typically of rudimentary nature. Substantial quantities of cement are required to fill large size cavities.

Also it is known for aerated or foamed cement compositions to be used in the manufacture of lightweight building blocks, such compositions being produced by one of two alternative methods. The foaming agent used may include one or more of the following materials: hydrolysed proteins, fatty acid salts, alkyl-aryl sulphonates, alkyl sulphates, phenol ethoxylates, the purpose of the foaming agent is to entrap air in a mix of foaming agent, cement and water. Foaming agents generally are based on materials which will lower surface tension of the composition and which help to maintain stability of air bubbles by slightly increasing the viscosity of the composition and by forming a stabilised skin to the bubbles. In one known method the foaming agent is added to the cement and water and the whole rigourously mixed. The foaming agent introduces and stabilises air bubbles during the mixing process. In an alternative method a stiff foam is first prepared usually in a form tube or via a venturi. The foamer device intimately mixes compressed air and the foaming agent solution to produce a continuous stream of stiff foam composed of small air bubbles. The stiff foam then is mixed with cement grout to produce an aerated cement grout. In both the above known methods fine or coarse aggregates may be introduced to the aerated cement grout.

Unfortunately, both the above prior known methods have disadvantages. With regard to the first disclosed method it is difficult to entrap sufficient air through a "whisking" technique to achieve both a desired density and a thixotropic characteristic. In addition, it takes a considerable period of time to whisk air into a mixture of cement grout and foaming agent. Moreover, this first technique does not lend itself to continuous operation and thereby obviates this method being used with the desirable very rapid setting cement compositions. With regard to the second disclosed method, it is a complicated manufacturing technique and therefore very difficult to operate in underground mining conditions. Also it is dependent upon two separate components, i.e., the foaming agent and the cement which must be mixed on site during the production of the aerated composition. Furthermore, it can result in an unhomogenous aerated composition being produced.

SUMMARY OF THE INVENTION

An object of the present invention is to provide a method of and apparatus for producing aerated cementitious compositions which tend to overcome or reduce the above disclosed disadvantages encountered with known methods and apparatus.

Accordingly, the present invention provides a method of producing an aerated cementitious composition comprising the stages of feeding ingredients comprising cement, foaming agent and liquid to a mixing chamber open to the atmosphere, mixing the ingredients fed to the mixing chamber, and pumping the wetted mixture produced to a desired site, the capacity of pumping being greater than the feed rate of ingredients into the mixing chamber such that in operation air is drawn into the mixing chamber and entrained in the wetted mixture.

Preferably, the feed rate of ingredients to the mixing chamber can be varied. It has been found that in the invention, the air drawn into the mixing chamber is compressed during pumping, and preferably there is no reduction of pressure until the point of use.

According to another aspect of the present invention apparatus is provided for carrying oiut the above defined method, the apparatus comprising a mixing chamber, feed means for feeding ingredients comprising cement, foaming agent and liquid to the mixing chamber, mixing means for mixing ingredients fed to the mixing chamber, pump means for pumping the wetted mixture produced to a desired site, the rated pumping capacity of the pump means being greater than the feed rate of ingredients to the mixing chamber such that in operation air is drawn into the mixing chamber and entrained in the wetted mixture.

Preferably, the feed rate of at least a portion of the feed means can be varied.

Conveniently, a previous prepared mixture of cement and foaming agent is fed to the mixing chamber, but the invention is in no way limited to the use of such a mixture.

Preferably, the feed means comprises a drive conveyor for feeding the mixture comprising cement and foaming agent to the mixing chamber and nozzle means for feeding liquid to the mixing chamber.

Preferably, the speed of the driven conveyor can be changed to vary the feed rate of the conveyor.

Advantageously, the driven conveyor is a screw conveyor.

Preferably, the mixing means comprises a screw conveyor arranged to urge the wetted mixture towards the pump means.

Advantageously, the screw conveyor and the pump means are driven from a common drive motor.

By way of example, one embodiment of the present invention will be described with reference to the accompanying drawing.

BRIEF DESCRIPTION OF THE DRAWINGS

FIG. 1 is a diagrammatic longitudinal section through the apparatus.

DETAILED DESCRIPTION OF THE DRAWINGS

The drawing shows a motor a drivably connected to a gearbox b having a gear control lever c. One gearbox output is drivably connected to a first screw conveyor e having a delivery feed hopper d and a discharge chute f arranged to feed material conveyed by the screw conveyor to a further feed hopper h for a second screw conveyor k which is drivably connected to a second output from the gearbox b, the hopper h being open to atmosphere. The drive from this second output is transmitted via the screw conveyor k to a pump l having a wide throat inlet directly connected to the output of the screw conveyor k and a discharge port m connected to piping (not shown) leading to a desired site. It will be appreciated that the screw conveyor k and hopper h constitute a mixing chamber for material fed into the hopper and the screw element p of the screw conveyor k constitute a mixing means for material in the mixing chamber.

Nozzle means g are provided to feed liquid, typically water, to the mixing chamber.

In operation to produce an aerated cementitious composition a mixture comprising cement and a foaming agent is placed in the feed hopper d for the screw conveyor e. The mixture comprises a blend of hydraulic cement and powdered foaming agent. The hydraulic cement may be, for example, Portland-type cement, high alumina cement, gypsum cement or blends thereof. In addition the mixture may comprise additives to confer desired properties such as thixotropy and/or rapid acceleration of setting time. The mixture may further comprise pulverised fuel ash, blast-furnace slag, calcium oxide or calcium hydroxide, silica or calcium carbonate. In a typical installation where the aerated cementitious composition produced is used to fill or partly fill cavities or voids in an underground mine, the mixture may comprise a quick setting cement as described and claimed in our prior British Patent Specification, No. 2,033,367. The specification discloses a quick setting cement comprising Portland Cement and by weight of Portland Cement ten to seventy percent of a mixture of calcium aluminate material and calcium-sulphate material one fourtieth to fifteen percent by weight of at least one inorganic salt and one fiftieth to three percent by weight of at least one of a carboxylic acid, a hydrocarboxylic acid or a salt of either of said acids. Reference may also be made to quick setting cement compositions described in U.K. published patent application No. 2,123,808A.

In a typical installation the foaming agent comprises a powdered surfactant capable of forming stable air bubbles in a hydraulic cement/water environment. The foaming agent may, for example, comprise a mixture of hydrolysed and unhydrolysed proteins, preferably selected for their synergistic characteristics. The preferred foaming agent is available under the designation Cormix NCB6 Special Blend from Cormix Limited, P.O. Box 132, Warrington, Cheshire WA5 1AG, England. Suitable dose rates for the foaming agent may be found by experiment, but are preferably about 0.1 to 5%, conveniently about 1%, by weight of the cement.

The screw conveyor e feeds the mixture comprising cement and foaming agent via the discharge chute f to the mixing chamber constituted by hopper h together with the screw conveyor k, the feed falling from the chute into the hopper. Water is fed to the mixing chamber from the nozzle means g such that the ingredients fed to the mixing chamber are mixed by the action of the mixing means constituted by the screw element p of the screw conveyor k. A further action of the screw conveyor k is to urge the wetted mixture towards the wide throat inlet of the pump l. The action of the pump l is to draw the wetted mixture from the mixing chamber and pump it via discharge port m and the piping to a desired site. The rated capacity of the pump l is greater than the rate at which the ingredients comprising the mixture comprising cement and foaming agent and water are fed to the mixing chamber. Thus the inlet to the pump tends to be only partially filled with wetted mixture and in consequence air is drawn into the mixing chamber to be mixed with the wetted mixture and fed to the pump. The action of the pump is to produce foaming of the wetted mixture and produce an aerated cementitious composition which is fed via discharge port m to the desired site.

Typically, in an underground installation the aerated cementitious composition pumped into voids or cavities which thereby are filled or partially filled by the quickly setting composition.

The two speed facilities provided by operation of the gear lever c enables the apparatus to fill either large overhead cavities in a high-speed mode or for filling smaller voids or cavities existing around roadway roof supports in a low-speed mode. Also the powder mixture comprising cement and foaming agent lends itself to transportation in underground conditions.

It will be appreciated that the preferred mixture of hydraulic cement and foaming agent when used in conjunction with the apparatus described with reference to the accompanying drawing provides a method of filling cavities or voids in underground mines which overcomes the disadvantages associated with previously known techniques for filling cavities either with conventional materials, for example, timber or broken rock or with the previously discussed foaming cement grouts having a relatively high specific gravity.

In preferred embodiments, the present invention produces a homogenous aerated cement grout which is thixotropic until it sets in approximately five minutes. It therefore, is suitable for pumping into overhead cavities. The specific gravity of the aerated grout can be varied from approximately 0.15 to 0.40 enabling both supportive and solely void filling compositions to be produced. At a typical specific gravity of 0.2 the composition requires 100 kilograms of solid ingredients per cubic meter of cavity filled. This compares with a typical previously known unaerated grout which requires 1000 kilograms of solid ingredients (i.e., cement) per cubic meter of cavity filled.

It is foreseen that use of the present invention is not restricted to cavity filling in underground mines; it is envisaged that the present invention could find application in engineering, civil engineering, construction and building, wherever it is desired to fill a space with or otherwise use a material having the intrinsic advantages of a low density aerated cementitious composition. The composition may, for example, find use as an insulation material.

In other embodiments of the invention the mixing chamber is constituted by the pump inlet. In such embodiments the mixing means need not urge the wetted material towards the pump means.

In further embodiments of the invention the cement and foaming agent are fed into the mixing chamber by separate feed means.

In some embodiments the foaming agent is fed into the mixing chamber with the liquid.

We claim:

1. A method of producing an aerated cementitious composition, comprising the simultaneous steps of (a) feeding ingredients comprising cement, foaming agent and liquid to a mixing chamber open to the atmosphere, (b) mixing the said ingredients with mixing means to produce a wetted mixture, and (c) feeding the wetted mixture with feeding means to pump means, wherein the feeding means comprises the mixing means, (d) pumping said wetted mixture with pump means to a desired site at a pump rate in excess of the feed rate of ingredients into the mixing chamber whereby air is drawn into said wetted mixture, wherein the cement is selected from the group consisting of Portland-type cement, high alumina cement, gypsum cement and blends of two or more thereof.

2. A method as claimed in claim 1, wherein the foaming agent is a mixture of hydrolysed and unhydrolysed proteins.

3. A method as claimed in claim 1, wherein the cement also includes additives selected from pulverised fuel ash, blastfurnace slag, calcium oxide, calcium hydroxide, silica and calcium corbonate.

4. A method as claimed in claim 1, wherein the cement and the foaming agent are fed together as a previously prepared mixture to the mixing chamber.

5. A method of producing an aerated cementitious composition comprising, placing a mixture comprising cement and a foaming agent in first feeding means, feeding the mixture with the first feeding means to a mixing chamber and adding water to the mixing chamber, mixing the water and the mixture in the mixing chamber with mixing means to form a cementitious composition, feeding the cementitious composition with second feeding means to pump means, pumping the cementitious composition from the mixing chamber to a desired site with the pump means, the pump means having a rated capacity greater than the rate at which the mixture and water are fed to the mixing chamber, and aerating the cementitious composition with the pump means wherein an inlet to the pump means tends to be only partially filled with the cementitious composition and wherein air is drawn into the mixing chamber to be mixed with the mixture and water and fed to the pump.

6. The method of claim 5 wherein the first feeding means comprises a first screw conveyor rotatable in a first feed hopper.

7. The method of claim 6 wherein the second feeding means comprises a second screw conveyor rotatable in a second feed hopper.

8. The method of claim 7 wherein an outlet of the first fee hopper is spaced from the inlet of the second feed hopper, wherein the inlet of the second feed hopper is open to the atmosphere.

* * * * *